United States Patent [19]

Swisher, Jr. et al.

[11] 4,213,719

[45] Jul. 22, 1980

[54] GRADE AVERAGING APPARATUS

[75] Inventors: George W. Swisher, Jr.; Thomas L. Steele, both of Oklahoma City, Okla.

[73] Assignee: CMI Corporation, Oklahoma City, Okla.

[21] Appl. No.: 946,606

[22] Filed: Sep. 28, 1978

Related U.S. Application Data

[63] Continuation-in-part of Ser. No. 887,004, Mar. 16, 1978, Pat. No. 4,140,420.

[51] Int. Cl.[2] ..... E01C 19/00

[52] U.S. Cl. ..... 404/84; 180/41; 280/6 R; 299/39

[58] Field of Search ..... 404/84; 280/6 R, 6 H; 37/DIG. 20; 299/39, 1, 41; 180/41

[56] References Cited

U.S. PATENT DOCUMENTS

| | | | |
|---|---|---|---|
| 2,962,979 | 12/1960 | McCormick | 404/84 X |
| 3,272,099 | 9/1966 | Drake | 404/84 |
| 3,323,427 | 6/1967 | Schrimper | 404/84 |
| 3,414,327 | 12/1968 | Austin | 299/1 |
| 3,595,144 | 7/1971 | Rink | 404/84 |
| 3,771,892 | 11/1973 | Munyon | 404/84 |
| 3,807,887 | 4/1974 | Tate | 404/84 |
| 3,811,787 | 5/1974 | Beaty | 404/84 |
| 3,846,035 | 11/1974 | Davin | 404/84 |
| 3,879,149 | 4/1975 | Smith | 404/84 X |
| 4,029,165 | 6/1975 | Miller | 404/84 X |

*Primary Examiner*—Nile C. Byers, Jr.
*Attorney, Agent, or Firm*—Dunlap, Codding & McCarthy

[57] ABSTRACT

An improved portable grade averaging apparatus comprising an averaging bar assembly that serves as an elevation control reference for a track supported road working machine. One end of an averaging bar member is pivotally supported by a forward steering drive track assembly that serves as a forward walking beam, and the other end of the averaging bar member is pivotally supported by a rear track assembly that serves as a rear walking beam. A grade sensor assembly supported on one side by the road working machine contactingly engages the averaging bar member for directing the elevation of one side of the road working machine to establish the elevation of a working tool supported by the road working machine.

12 Claims, 6 Drawing Figures

GRADE AVERAGING APPARATUS

Cross References

The present application is a continuation-in-part to U.S. Patent Application Ser. No. 887,004, entitled "A PORTABLE GRADE AVERAGING APPARATUS", filed Mar. 16, 1978, now U.S. Pat. No. 4,140,420.

BACKGROUND OF INVENTION

1. Field of Invention

The present invention relates generally to road working machines and, more particularly but without limitation, to an improved apparatus for providing a portable elevation control reference.

2. Prior Art

When a road working machine having a work piece, such as a planing cutter, is utilized to perform a surfacing operation on a roadway, such as a surface planing operation, an elevation control reference may be disposed alongside the roadway when the finished surface is to have a predetermined elevation. One of the more common means for establishing an elevation control reference is a conventional stringline setup positioned alongside the roadway. Sensing means on the road working machine continuously sense the elevation of the stringline above grade and provides an elevation control signal to an elevation control assembly provided as a part of the road working machine. In turn, the elevation control assembly maintains the work piece at a predetermined working elevation, or cutting depth, in relation to the grade of the roadway surface. Thus a uniform finish grade can be formed which is substantially free of high or low spots. In some instances, an existing curb alongside the roadway may be utilized in place of a stringline as the elevation control reference, if the grade elevation of the curb is generally uniform in relation to that of the roadway.

Stringline setups have proven to be very valuable as utilized to provide an elevation control reference for making an initial pass down a roadway surface. It is relatively simple to construct a stringline setup along a shoulder portion of the roadway in a manner convenient to the positioning of the elevation sensing device. However, as subsequent passes are made along the roadway, it becomes highly impractical to utilize the initial stringline setup, and it is not economical to construct a separate stringline setup for each pass made by the road working machine. This is particularly true when the roadway is relatively wide.

There are also many occasions when a planing operation is utilized to remove a specified amount of material from an existing roadway. An example of such would be where a planing specification requires the removal of the surface of a roadway down to a specified depth measured in inches below an existing roadway surface.

Whether the roadway working machine is to remove surface material by referring to a stringline or to the existing surface itself, it would be desirable to have an elevation control reference which is portable, or which more or less, is always carried with the road working machine, or which can be readily attached thereto. Although not meeting this description, walking beam assemblies connected alongside a road working machine have been utilized in some instances to provide an elevation control reference which is roughly indicative of the desired finish grade. A walking beam assembly of this latter type is disclosed in U.S. Pat. No. 3,414,327, issued to Austin.

In the Austin patent, a grade elevation sensor assembly is utilized for determining the average grade elevation of the roadway forward of the work piece. The grade elevation sensor assembly provides a control signal indicative of this average grade elevation, and the control signal does substantially maintain the work piece at a predetermined working depth. However, since the grade elevation sensor assembly senses the grade elevation of the roadway forwardly of the work piece, the work piece will generally be maintained at a working depth indicative of the average grade elevation forward of the work piece as opposed to the average grade elevation next to the work piece. Thus, the resulting finish grade formed via the work piece will not be as uniform as if the work piece had been positioned at a working depth indicative of the average grade elevation of the roadway in near proximity to the work piece.

An additional problem with conventional portable walking beam assemblies is that they restrict the maneuverability of the road working machine. In use of a road working machine employing a planing cutter, by way of example, the machine frequently must take multiple cutting passes along the roadway. At the end of each pass, the machine must be maneuvered into position to make the next cutting pass. It is not unusual to find that the machine must be turned around and repositioned to travel in the opposite direction, and such turn around often must be performed in tight quarters having minimum clearance and maneuvering room. When a conventional portable control reference apparatus is attached to the road working machine, more turn around area must be provided in which the machine is repositioned, or the control reference apparatus must be removed before turning the machine, and remounted once the machine is repositioned.

Summary of Invention

The present invention is related to the above mentioned U.S. Patent Application No. 887,004, and the disclosure contained therein is incorporated by reference into the present disclosure. The present disclosure deals with a portable grade averaging apparatus that is supported along one side of the road working machine, and provides a portable grade averaging apparatus for providing an elevation control reference that is adjacent to a work piece carried beneath the frame of the road working machine. The grade averaging apparatus is continuously contacted by a grade sensor, the elevation control reference being indicative of the average grade of selected reference surfaces near the work piece. More particularly, the apparatus utilizes a front steering drive track assembly of the road working machine as a forward walking beam, and it utilizes a rear drive track assembly as a rear walking beam. The forward steering drive track assembly, serving as a track walking beam, provides a forward elevation reference indicative of the average grade elevation forwardly of the work piece, and the rear drive track assembly, serving as a track walking beam, provides a rear elevation reference indicative of the average grade elevation rearwardly of the work piece. An averaging bar member, pivotally supported by each of the forward steering drive track assembly and the rear drive track assembly provides the elevation control reference which is indicative of the average of the front elevation reference and the rear elevation reference. Since the front steering drive track assembly must be free to swivel relative to the frame of the road working machine in order to effect steering of the machine, a swivel plate assembly is supported by the front steering drive track assembly and bearingly supports the forward end of the averaging bar member in a manner that permits both pivotation and swiveling motion of the forward steering drive track assembly relative to the forward end of the averaging bar member.

It is an object of the present invention to provide an improved grade averaging apparatus that is connectable to a road working machine such that the forward and rear track assemblies along one side of the machine serve as track walking beams to provide an elevation control reference indicative of the average of the grade elevations forwardly and rearwardly of a work piece connected to the frame of the road working machine.

Another object of the present invention is to utilize the supporting drive track assemblies of one side of a road working machine as the grade averaging portions of the grade averaging apparatus, without further need of other grade averaging devices along that side of the road working machine.

Yet another object of the present invention is to provide a self-storing portable grade averaging apparatus that affords greater maneuverability for the road working machine.

A further object of the present invention is to provide an improved portable grade averaging apparatus that offers simplicity of construction, and which requires minimum upkeep and repair.

Other objects, advantages and features of the present invention will become apparent from the following detailed description when read in conjunction with the accompanying drawings and appended claims.

Description of the Embodiment

Figure 1:
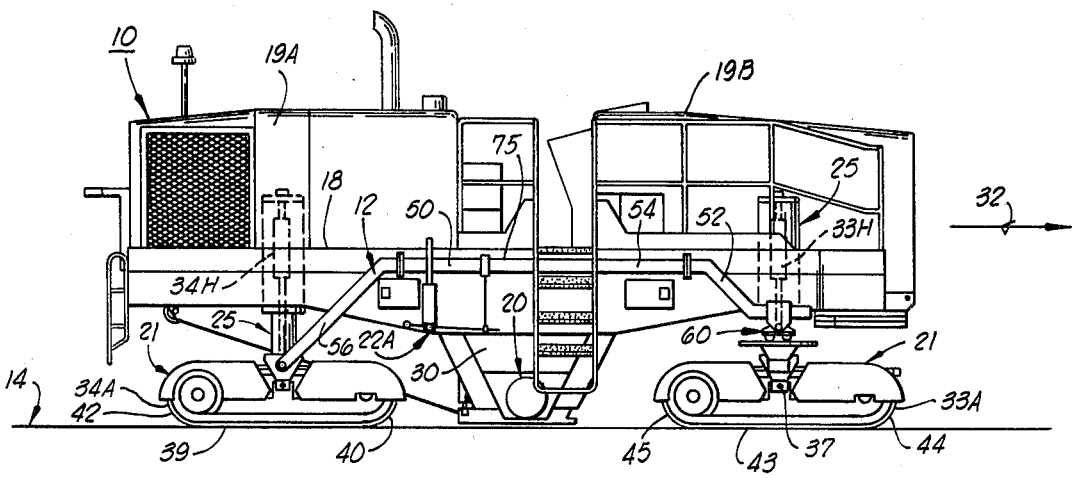
FIG. 1 is a side elevation view of the grade averaging apparatus of the present invention in an assembled position with a road working machine.
Figure 2:
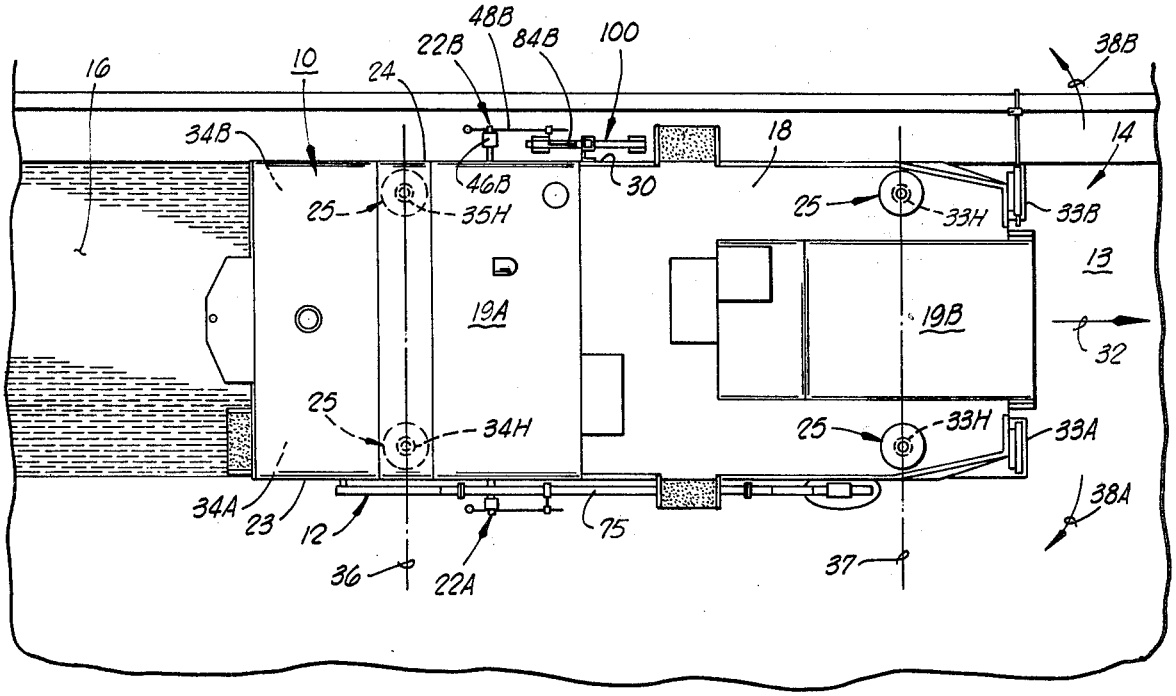
FIG. 2 is a plan view of the grade averaging apparatus and the road working machine shown in FIG. 1.

Referring to the figures in general, and to FIGS. 1 and 2 in particular, shown therein is a road working machine 10 assembled in combination with a grade averaging apparatus 12 constructed in accordance with the present invention. The road working machine 10 that is shown is a planar apparatus that is generally utilized to perform surfacing or resurfacing operations on an existing, or old grade 13 of a roadway 14. The grade averaging apparatus 12 is utilized to provide a first elevation control reference generally indicative of, or proportional to, a selected surface whereby a new surface, or finished grade 16, is formed, as will become more clear below. In the interest of simplifying the drawings included in the present disclosure, details such as hydraulic conduits, electrical lines, and machine controls have not been shown as such are conventional and need not be described for purposes of this disclosure.

An illustrative example of a conventional road working apparatus such as the machine 10 is disclosed in U.S. Pat. No. 4,139,318, entitled "A Method and Apparatus for Planing a Paved Roadway", assigned to the assignee of the present invention. Even though the present invention is particularly applicable to the planing of a paved roadway, it should be noted that the present invention is also applicable to other roadway surfaces such as, for example, grading. Furthermore, as will be clear to one skilled in the art, even though the road working apparatus related to the above mentioned patent application as disclosed therein has been utilized for planing a paved roadway, it is contemplated that the basic form of such a road working apparatus could, with minor modifications, be used for other road surfacing operations such as, for example, grading.

In a basic form, the road working machine 10 generally comprises a frame 18; a prime mover, such as a diesel power plant 19A; a hydraulic pump assembly 19B; a work piece 20 supported by the frame 18; a drive assembly 21 connected to and supporting the frame 18; a grade sensor assembly 22A connected to the frame 18 and supported adjacent the work piece 20 near a right side 23 of the frame 18; another grade sensor assembly 22B connected to the frame 18 and supported adjacent the work piece 20 near an opposite, or left, side 24 of the frame 18; and an elevational control assembly 25, connected to the frame 18 and having portions connected to the drive assembly tracks of the drive assembly 21, as will be described more fully below.

The frame 18 substantially includes the chassis, body panels, and in general, all of the supportive and protective portions and components normally associated with a road working machine such as the machine 10.

The work piece 20 is rigidly attached to the underside of the frame 18 and extends generally transversely to a medial portion of the frame 18, and therefore the work piece 20 also extends generally transversely to the roadway 14. The elevation of the work piece 20, which is the portion of the road working machine 10 that interacts with the roadway 14, is determined by the elevation of the frame 18. Of course, the type of surfacing operation performed on the roadway 14 by the road working machine 10 is determined by the kind of work piece utilized.

Figure 3:
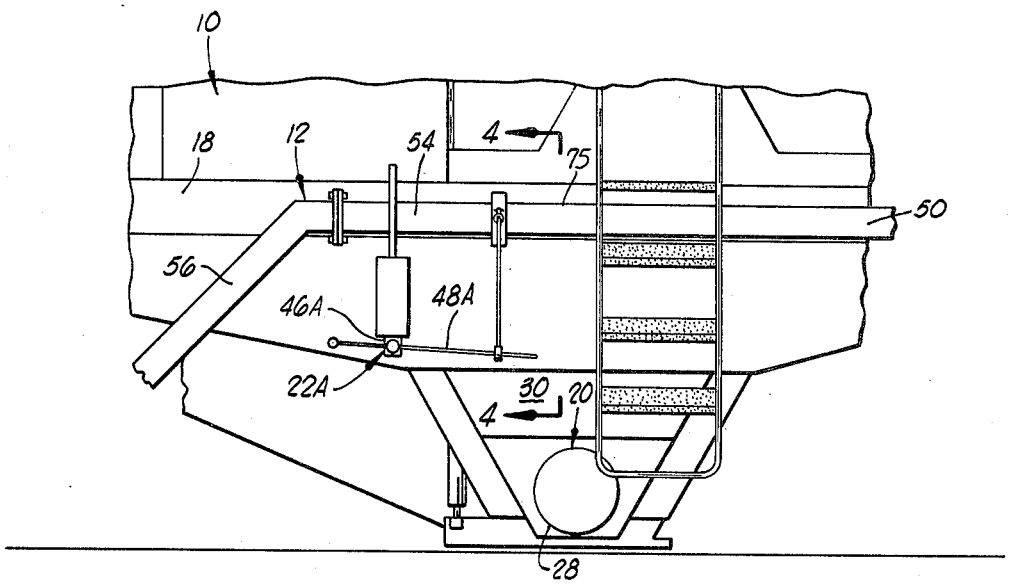
FIG. 3 is a close-up view of a portion of the apparatus shown in FIG. 1.

In one embodiment of the present invention and as shown more clearly in FIG. 3, the work piece 20 is in the form of a drum type planer apparatus 28, such as that disclosed in the above mentioned patent No. 4,139,318. A planer housing 30 is disposed about the planer apparatus 28 to contain road material cuttings produced by the planer apparatus 28 and to form a supportive means for other components of the present invention to be discussed below.

As shown in FIGS. 1 and 2, the drive assembly 21, provided for moving the frame 18 in a forward direction 32 as powered by the conventional prime mover 19A and the hydraulic pump and transmission 19B (not detailed), comprises a right front steering drive track assembly 33A, a left front steering drive track assembly 33B, a right rear drive track assembly 34A, and a left rear drive track assembly 34B. The rear drive track assemblies 34A and 34B are pivotally connected to the frame 18 so as to be pivotable about a rear control axis 36 disposed rearwardly of the work piece 20, and for convenience of description herein, the rear drive track assemblies 34A, 34B will be referred to respectively as right and left rear drive track assemblies, said designations arbitrarily assigned from the perspective of an operator of the machine 10 who is facing in the forward direction 32.

In like manner to that above described for the rear drive track assemblies 34A and 34B, the front steering drive track assemblies 33A and 33B are pivotally connected to the frame 18 so as to be pivotable about a forward control axis 37 disposed forwardly of the work piece 20. Also each of the front steering drive track assemblies is connected via conventional steering means so as to swivel in the rotational directions 38A and 38B as shown by the respective arrows in FIG. 2. This permits the machine 10 to be steered by selectively directing the front steering drive track assemblies 33A and 33B to swivel in unison as the machine 10 is operated.

Each of the rear drive track assemblies 34A and 34B has a ground contact portion 39 which is in continuous driving contact with a surface portion of the roadway 14 as the frame 18 is moved in the forward direction 32 by the drive assembly 21. The ground contact portion 39 of each rear drive track is further characterized as having a leading end 40 and a trailing end 42. The distance between the leading end 40 and the trailing end 42 (that is, the length of the ground contact portion 39) defines the effective span of the respective rear drive track assemblies 34A and 34B. Furthermore, each of the rear drive track assemblies 34A and 34B is of such construction that the ground contact portion 39 extends in a planar fashion between the leading and trailing ends 40 and 42 thereof regardless of the contour of the supporting grade. Thus, the elevation above grade of the rear control axis 36 at each side of the frame 18 at any selected position relative to the roadway 14 will be indicative of, or proportional to, the average of the difference (if any difference exists) between the grade elevations of the leading and trailing ends 40 and 42 of the ground contact portions 38.

In like manner to that described for the rear drive track assemblies 34A and 34B, each of the forward steering drive track assemblies 33A and 33B has a ground contact portion 43 which is in continuous driving contact with the roadway 14. The round contact portion 43 of each front steering drive track assembly has a leading end 44 and a trailing end 45, and the distance between these ends defines the effective span of the respective forward steering drive track assemblies 33A and 33B. Furthermore, each of the forward steering drive track assemblies 33A and 33B is of such construction that the ground contact portion 43 extends in a planar fashion between the leading and trailing ends 44 and 45 thereof regardless of the contour of the supporting grade. Thus, the elevation above grade of the front control axis 37 at each side of the frame 18 at any selected position relative to the roadway 14 will be indicative of, or proportional to, the average of the difference (if any difference exists) between the grade elevations of the leading and trailing ends 44 and 45 of the ground contact portions 43.

The grade assembly 22A, shown more clearly in FIG. 3, is preferably connected to a portion of the frame 18 in near proximity to the work piece 20 in a selectively positionable manner, and is utilized to sense the first elevation control reference provided by the grade averaging apparatus 12. In response to sensing the first elevational control reference, the grade sensor assembly 22A provides a first elevation control signal to a portion of the elevation control assembly 25 which is indicative of, or proportional to, a deviation of the right end of the work piece 20 from the first elevation control reference, as will become more clear below. The grade sensor assembly 22A has a sensor actuating portion which specifically senses the first elevation control reference and, in response thereto, causes the grade sensor assembly 22A to provide the first elevation control signal. In the preferred embodiment, the grade sensor assembly 22A is in the form of a hydraulic sensor 46A having a sensing wand 48A which generally defines the sensor actuating portion thereof. More particularly, in the preferred embodiment, the sensing wand 48A is pivotally connected to the hydraulic sensor 46A and controls the positioning of a fluid valve (not shown) disposed therein, with the fluid valve controlling fluid flow to a portion of the elevation control assembly 25, as will become clear below.

The grade sensor assembly 22B, located near the opposite side 24 of the frame 18, and viewable in FIG. 2, is similar in construction to that described for the grade sensor assembly 22A, and comprises a corresponding hydraulic sensor 46B and sensing wand 48B. In like manner to that described for the grade sensor assembly 22A, the grade sensor assembly 22B provides a second elevation control signal via the positioning of a fluid valve that controls fluid flow to a portion of the elevation control assembly 25. The grade sensor assembly 22B cooperates with other apparatus, described below, to sense the positioning of a second elevation control reference.

The elevation control assembly 25 is utilized to vary the elevation of the frame 18, and consequently, the work piece 20 in response to the elevation control signals provided via the grade sensor assemblies 22A and 22B. Thus, the elevation and slope of the work piece 20 is determined relative to the first and second elevation control references. In other words, the work piece 20 is selectively positionable in a vertical manner by the operation of the elevation control assembly which determines the elevation of the frame 18. In the road working machine 10 herein described, the elevation control assembly 25 comprises hydraulic cylinder 34H and 35H that are connected respectively between the frame 18 and the right rear drive track assembly 34A and the left rear drive track assembly 34B. The hydraulic cylinders 34H and 35H, shown in broken line detail in FIGS. 1 and 2, serve to position the frame 18 vertically relative to the supporting rear drive track assemblies 34A and 34B. Also, the elevation control assembly 25 comprises a pair of hydraulic cylinders 33H that are connected between the frame 18 and the front steering drive track assemblies 33A and 33B; the hydraulic cylinders 33H serve to vertically position the front portion of the frame 18 relative to the front steering drive track assemblies 33A and 33B. The grade sensor assemblies 22A and 22B are in fluid communication with the elevation control assembly 25 by valves and conduits that are not shown in the drawings, but which are conventional in the prior art.

With further reference to FIGS. 1 and 2, the grade averaging apparatus 12, which has been referred to above, generally comprises a bar member 50 having a forward end 52, a mid portion 54 and a rear end 56. The rear end of the bar member 50 is pivotally connected to the right rear drive track assembly 34A via a bearing connection to a stationary arbor supported by the right rear drive track assembly 34A near the rear control axis 36 at a pivoting point defining the rear elevation reference.

Figure 5:
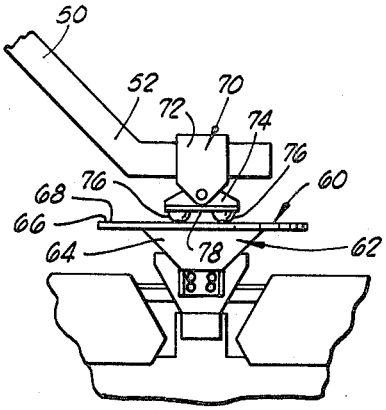
FIG. 5 is an elevational view of the forward end of the averaging bar member and the swivel plate assembly of the apparatus of FIG. 1.
Figure 6:
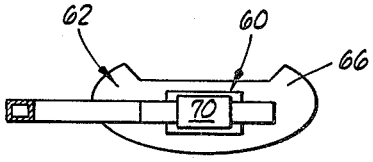
FIG. 6 is a top plan view of the forward end of the averaging bar portion shown in FIG. 5.

The forward end 52 of the bar member 50 is supported by a bar connecting assembly 60 as shown in FIG. 1, and as also shown in more detail in the partial views of FIGS. 5 and 6. Supported by the right forward steering track assembly 33A, the bar connecting assembly 60 is comprised of a swivel plate assembly 62 that includes a mounting base 64 shaped in the form of a pedestal and attached to the left forward steering drive track assembly 33A via bolting means. Attached to the upper portion of the mounting base 64 is a platform member 66 that is a planar member generally horizontally disposed and generally curvilinearly shaped (as best shown in the plan view of FIG. 6). The platform member 66 has an upper surface 68 that serves as a bearing surface upon which the weight of the forward end 52 of the bar member 50 is borne.

The bar connecting assembly 60 also comprises a bearing assembly 70 that attaches to the forward end 52 of bar member 50 and which is interposed between bar member 50 and the swivel assembly 60. The bearing assembly 70 is comprised of a block portion 72 having a bore (not shown) through which the bar forward end 52 extends. Locking means secure the block 72 in a determined position on the bar forward end 52. A swivel ball assembly 74 is attached to the block 72 at the lower end of the bearing assembly 70. The swivel ball assembly 74 has a pair of swivel casters 76, retained in a race 78, that engage the bearing surface 68 of the swivel platform 66.

The bar connecting assembly 60 supports parts of the weight of the bar member 50 and transfers that weight to the right front steering drive track assembly 33A in a manner that permits the swiveling movement of the track 33A beneath the bar member 50 without affecting the elevation of the bar member. This will be described in more detail below.

Figure 4:
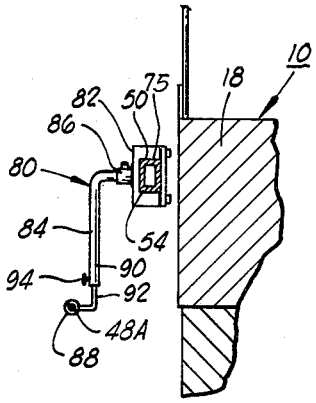
FIG. 4 is a view of a portion of the apparatus taken generally along the line 4—4 in FIG. 3.

The shape of the bar member 50 is not believed to be limiting in the present invention, and as drawn in the present disclosure, the forward end portion 52 and the rear end portion 56 are angularly attached to the mid portion 54 such that the mid portion 54 is positioned at a convenient elevation to meet the placement needs of the right grade assembly 22A. It will be recognized that other shapes could be assigned to the bar member 50, but it is recommended that the shape be established such that the mid portion 54 is generally horizontally disposed when the road working machine 10 is on substantially level ground. In the drawings attached hereto, the bar member 50 is composed of hollow, square stock portions, and the mid portion 54 has an upper surface that is designated by the numeral 75. As shown in FIG. 4, an attaching member 80 is provided to connect the sensing wand 48A to the bar mid portion 54.

The attaching member 80 comprises a bracket 82 having a bore through which the cross sectional shape of the bar member 50 is passable, and an extendable arm assembly 84. The bracket 82 has a socket 86 which secures to one end of the arm assembly 84 via locking means, while the other end of the arm assembly 84 has a loop portion 88 that is disposable over the sensing wand 48A. The arm assembly 84 has a hollow upper portion 90 into which the upper end of the lower portion 92 of the arm assembly 84 is received. A locking screw 94 secures these two portions together to determine the length of the arm assembly 84. This arrangement connects the wand 48A to the bar member 50, and the position of the upper surface 75 of the bar mid portion 54 determines the elevation of the wand 48A.

Turning again to the rear track assembly 34A, it will be clear that the pivotal nature of the right rear drive track assembly 34A about the rear control axis 36 causes the right rear drive track assembly 34A to act as a track walking beam, and the rear elevation reference is therefore indicative of the average grade of the surface that supports the right rear drive track assembly 34A. The bar member 50 is connected at a pivot point on the track assembly 34A that is fixed in constant spatial relationship to the rear control axis 36; for this reason, a change in elevation of the rear control axis 36 will effect an exact elevational change to the rear elevation reference (defined as passing through the center of the arbor or pivot point to which the bar rear end 56 is connected).

In like manner, the bar forward end 52 is supported via the bar connecting assembly 60 to provide a pivot point defined by the contacting area of the swivel ball 76 of the bearing assembly 70 that bearingly engage the bearing surface 68 of the swivel plate assembly 62. This arrangement provides for a pivotal support of the bar forward end 52 relative to the right forward steering drive track assembly 33A. The pivotal nature of the right forward steering drive track assembly 33A about the forward control axis 37 causes the track 33A to act as a track walking beam; consequently, the elevation of the forward control axis 37 is determined by the average grade of the surface supporting the right forward steering drive track assembly 33A. The forward elevation reference, defined as passing through the point of contact of the swivel ball 76 with the bearing surface 68, remains a fixed distance away from the forward control axis 37, even though this axis will turn with the swivel rotation of the track assembly 33A. Of course, practical construction considerations bear upon these relationships, and it is recognized that the bearing surface of the swivel balls 76 is an area of contact and not that of a single point. However, one caster could be used in the present invention, or other means could be utilized which would more exactly define a point of pivotation that could then more accurately be referred to as a forward elevation reference, but for purposes of the present invention, the described arrangement of multiple swivel balls has proven to be satisfactory for providing sufficient operating sensitivity and for distributing the stress over a larger area of contact. Further, it is recognized that a swivel rotation of the track 33A varies somewhat the distance between the forward elevation reference and the forward control axis 37 (however, the distance between the vertical center of the track 33A and the forward elevation reference remains constant). As the right forward steering drive track assembly 33A swivels, the platform member 66 turns under the bearing assembly 70 such that the swivel casters 76 bear against the bearing surface 68 along a travel arc of contact. This arrangement permits steering rotation of the forward steering drive track assembly 33A without effect on the elevation of the forward elevation reference. A change of elevation of the forward control axis 37 as the forward steering drive track assembly 33A passes over surface irregularities will effect an identical change in elevation to the forward control reference to the bar forward end 50.

From the above, it will be clear that if the bar 50 were to extend linearly between the rear elevation reference and the front elevation reference in parallel relationship to the roadway 14, the mid point therebetween as located on the bar 50 would substantially define an elevation above grade generally indicative of the average of the rear elevation reference and the front elevation reference. However, in a more practical situation, since the bar 50 is constructed to conform to requirements of the road working machine 10, the actual mid point between the rear and front elevation references, as located on the bar member 50, may not accurately define the elevation control reference as an average of the contour sensed by the forward and rearward track assemblies 33A and 34A. Accordingly, the bracket 82 of the attaching member 80 is adjustable along the mid portion 84, within the other structural restraints above mentioned, in order to achieve optimum placement thereof corresponding to achieving indication of the average elevation between the forward and rear walking beams provided by the forward and rear track assemblies 33A and 34A.

As mentioned above, the grade sensor assembly 22B, shown in FIG. 2, is located on the opposite side 24 of the frame 18, and serves in a similar manner to that described for the grade sensor assembly 22A that is located on side 23 of the frame 18. That is, the sensing wand 48B of the grade sensor assembly 22B serves to sense the location of an arm 84B that extends from a conventional skid assembly 100 that is supported by the planer housing 30 along the opposite side 24. Of course, another grade averaging apparatus constructed in accordance with the present invention and similar to the grade averaging apparatus 12 could be attached to the side 24, and if this were done, the wand 48B would be actuated by an attaching member similar to the attaching member 80. However, for the purpose of this disclosure, a conventional skid 100 is displayed in FIG. 2, and since the construction of such skids is known, details need not be given herein except to comment that the skid 100 is constructed to slide along a surface adjacent the opposite side 24 as the road working machine 10 moves along the roadway 14.

It will be recognized that a stringline could be set up for sensing by the wand 48B, in which case the wand 48B would be oriented to extend generally normal to the side 24. As will be discussed below, the use of a stringline is an option that may be desirable for a cutting pass close to the edge of a roadway. Another option of controlling the elevation of a portion of the frame 18 is a conventional slope control that would position one portion of the frame 18 at a constant setting relative to another portion of the frame 18. Since slope controls are well known, further discussion need not be provided.

Operation

During a typical surfacing operation, such as a surface planing operation performed by the work piece 20, the road working machine 10 and the work piece 20 are initially aligned over the roadway 14 at a designated take-off area, with the work piece 20 being disposed generally transversely to the roadway 14. The take-off area generally defines the starting point of an initial pass to be made over the roadway 14 by the machine 10.

Before the machine 10 begins the initial pass, an elevation control reference is normally established along the side 24 in order to maintain the working depth of the work piece 20 at a constant elevation relative to the roadway surface. For the initial pass, the second elevation control reference along the edge of the roadway 14 may be provided in a conventional manner such as by the use of a stringline along the edge, or if there should be a curbing surface or the like adjacent the roadway 14, the skid 100 (or a grade averaging assembly similar to the grade averaging assembly 12) may be utilized to provide the second elevation control reference for the initial pass. That is, the present grade averaging apparatus 12 can be used on either side or on both sides of the machine 10; or the grade averaging apparatus can be used on one side of the machine 10 while the elevation of the opposite side of the machine 10 is controlled by a stringline, by a conventional skid apparatus, or by a cross slope control. In the interest of brevity herein, the present invention will be discussed with the machine 10 equipped with the skid 100 on one side of the machine and with the grade averaging apparatus 12 on the other side. The assignment of the machine 10 for the purpose of this discussion will be to remove the top surface of the roadway 14 to a uniform depth of a determined number of inches measured from the top of the existing grade.

In this mode of the machine 10, the elevation of the frame 18 would be controlled as follows. The first elevation control reference is provided by the grade averaging apparatus 12, and the grade sensor 22A provides the first elevation control signal to a portion of the elevation control assembly 25 as the sensing wand 48A is actuated as the machine 10 progresses forward. The hydraulic cylinder 34H, connected between the frame 18 and the right rear drive track assembly 34A, is actuated and positioned in response to this first elevation control signal.

Continuing the discussion of this mode of the machine 10, the second elevation control reference is provided by the skid apparatus 100, and the grade sensor 22B provides the second elevation control signal to a portion of the elevation control assembly 25 as the sensing wand 48B is actuated by the skid 100 as it moves along the surface adjacent to the side 24 of the frame 18. The hydraulic cylinders 33H connected between the frame 18 and the front steering drive track assemblies 33A, 33B are hydraulically coupled and are actuated for extension or contraction in response to the second elevation control signal.

In operation, the roadway machine 10 is positioned to make the initial pass. The skid 100 is supported on a curb apron or the like along the edge of the roadway 14, and the grade averaging apparatus 12 is supported alongside the machine 10 on the existing pavement surface of the roadway 14. While in this position, the elevation of the frame 18 is altered by manually controlling the hydraulic cylinders 33H, 34H and 35H (by manual controls not shown) to position the work piece 20 in touching contact with the top of the roadway 14. That is, the axis of the work piece 20 will at this point have been placed in transverse and parallel relationship to the top surface of the roadway 14 since the slope of the axis of the work piece 20 will be the same as the transverse slope of the roadway 14. Once this has been achieved, the rotation of the work piece 20 is commenced, and the entire frame 18 is lowered by the required number of inches necessary to achieve the specified depth of cut. At this point, the machine 10 is advanced until the rear drive track assemblies are positioned on the finish grade 16, and the hydraulic cylinder 35H is locked in a fixed position to lock the left rear drive track assembly 34B to grade. This establishes the rear portion of the frame 18 on the side 24 at a fixed elevation above the newly cut finish grade 16. The elevation control assembly is now set on its automatic mode to maintain the specified cutting depth as controlled by the grade sensor assemblies 22A and 22B that respectively control the elevation of the frame 18 by effecting the extension, respectively, of the hydraulic cylinders 34H and 33H. At this point, the roadway machine 10 is prepared for cutting advancement along the roadway 14.

As the machine 10 moves forward, a depression in the existing grade, were it not for the present invention, would cause the work piece 20 to deviate downwardly to an elevation below the desired cutting depth. However, the first elevation control signal provided by the grade averaging apparatus 12 of the present invention will offset this tendency by signalling the elevation control assembly to change the elevation of the frame 18 (and consequently the elevation of the work piece 20) by an amount proportional to an average of forwardly and rearwardly sensed grade elevations. In this way, the work piece 20 will be maintained at a more uniform cutting depth in relation to the average grade elevation of the roadway 14 as indicated by the grade averaging apparatus 12.

The work piece 20 forms a work path as the road working machine 10 makes it initial pass over the roadway 14, with the rear drive track assemblies 34A and 34B following the work path in the wake of the work piece 20 when the distance span of the rear drive track assemblies 34A and 34B is less than the transverse length of the work piece 20. When a planing operation is being performed by the machine 10, the work path represents that portion of the roadway 14 which has been planed, designated as the finish grade 16. As mentioned above, the elevation controls must be adjusted once the rear drive tracks 34A and 34B are resting in the work path so as to obtain the desired cutting depth.

After the initial pass has been completed, the road working machine 10 is usually positioned to make at least one, and generally several subsequent passes adjacent to the initial pass until the entire roadway 14 has been exposed to the planing operation. During all subsequent passes, as in the initial pass, the grade averaging apparatus 12 is again utilized to provide the first elevation control reference, and the skid apparatus 100 again is repositioned to provide the second elevation control reference. However, during the subsequent passes, the skid 100 will slide along the cut work path of the previous pass, necessitating adjustment of the elevation of the frame 18 once again as described above for the commencement of the initial pass.

More particularly, with respect to the operation of the grade apparatus 12 of the present invention, it should be noted that a deviation in the surface of the roadway 14 will first be sensed by the forward walking beam, the forward steering drive track assembly 33A, and a deviation in the surface of the work path will be sensed by the rear walking beam, the rear drive track assembly 34A. The forward elevation reference sensed by the forward walking beam will be averaged with the rear elevation reference that is sensed by the rear walking beam, with the elevation of the averaging bar member 50 being effected thereby. Therefore, the first elevation control signal provided by the hydraulic sensor 46A will be indicative of, or proportional to, a twice-averaged deviation, as opposed to responding directly to any given deviation. Thus, the cutting depth of the work piece 20 will be varied as necessary to maintain a more uniform cutting depth with each pass.

To further explain the averaging effect of the track walking beams, the operation of the right rear drive track 33A will be considered, by way of example. When the right rear drive track assembly 34A travels over a depression in the work path, the elevation of the rear control axis 36 of the rear drive track assembly 34A will be changed only if the distance across the depression is greater than half the distance from the leading end 40 to the trailing end 42, since the planar nature of the ground contact portion 38 of the rear drive track assembly 34A. Even if the depression, or surface irregularity, in the work path is of sufficient size to be sensed by the right rear drive track assembly 34A, will cause the track assembly to span any smaller depressions, the elevation of the rear control axis 36 will be averaged with the grade concurrently sensed by the forward walking beam 33A to determine the elevation of the averaging bar member 50.

After the road working machine 10 finishes a pass and is being maneuvered to its next cutting position, the portability and simplicity of operation of the grade averaging assembly 12 will be appreciated. Since the grade averaging assembly 12 is completely self contained upon the road working machine 10, the machine 10 is simply operated in its manual mode during repositioning maneuvers without regard to the grade averaging assembly 12. As soon as the machine 10 is readied in its new position, the grade averaging apparatus 12 will be automatically positioned to continue operations in the manner discussed above. Once the machine is in position for the next pass, only minor elevation adjustment is usually necessary before the operator can place the elevation control assembly back into its automatic control mode. If the elevation of the frame 18 deviates from the required elevation in order to null the grade sensor assemblies 22A and 22B, the elevation of the frame 18 will automatically be reset for the start of this pass because of the determined cutting depth having been before established. This demonstrates the ease of establishing an elevation control reference afforded by the portable grade averaging apparatus 12 of the present invention.

As mentioned above, another grade averaging apparatus constructed in accordance with the present invention and which is similar to the grade averaging apparatus 12 can be utilized alongside the opposite side 24 of the frame 18 instead of using the skid apparatus 100. In practice, since the uniformity of the cutting depth achieved by using the grade averaging apparatus 12 is quite good, it has been determined that a conventional skid 100 may be used on one side of the machine 10 where the skid 100 is to slidingly contact a curb apron during the initial pass, and the skid 100 is to slidingly contact the work path of the previous pass during subsequent passes of the roadway machine 10.

It is believed that it will be clear from the above disclosure that the present invention is well adapted to carry out the objects and to attain the ends and advantages herein mentioned, as well as those which are inherent therein. While a presently preferred embodiment of the invention has been described for the purpose of this disclosure, numerous changes may be made which will readily suggest themselves to those skilled in the art and which are encompassed within the spirit of the invention disclosed and as defined in the appended claims.

What is claimed is:

1. An improved grade averaging apparatus for use with a road working machine having a frame supporting a work piece for working contact with a roadway surface, the frame supported by a drive assembly having at least one rear drive track connected to the frame and pivotable about a rear control axis, and the drive assembly having at least one forward steering drive track connected to the frame and pivotable about a forward control axis, the forward steering drive track supported to accommodate swivel rotation to steer the road working machine, and the elevation of the work piece determined by an elevation control device sensing an external elevation control reference, comprising:

a bar member supported independently to the frame of the road working machine and having a forward end and a rear end, the rear end of the bar member pivotally connected to the rear drive track at a selected attachment point defining a rear elevation reference, the position of the rear elevation reference being constantly fixed relative to the rear control axis, the elevation of the rear elevation reference being indicative of the average grade of the roadway surface supporting the rear drive track; and bar connecting means supporting the forward end of the bar member and connected to the forward steering drive track for providing a pivot point between the forward end of the bar member and the forward steering drive track such that the pivot point defines a forward elevation reference the position of which is constantly fixed relative to the forward control axis throughout the range of swivel of the forward steering drive track, the elevation of the forward elevation reference being determined by the average grade of the roadway surface supporting the forward steering drive track, and the bar member providing the elevation control reference indicative of the average of the forward elevation reference and the rear elevation reference.

2. The apparatus of claim 1 wherein the bar connecting means comprises:

a swivel plate assembly supported by the forward steering drive track and having a bearing surface; and bearing means attached to the forward end of the bar member for engaging the bearing surface of the swivel plate.

3. The apparatus of claim 2 wherein the bearing means is characterized as comprising a swivel ball assembly with at least one swivel ball in rolling engagement with the bearing surface of the swivel plate.

4. The apparatus of claim 3 wherein the swivel plate assembly is characterized as comprising:

a mounting base supported by the forward drive track; and a platform member supported by the mounting base, a portion of the platform member forming the bearing surface which is generally horizontally disposed.

5. The apparatus of claim 4 wherein the platform member is generally curvilinearly shaped and provides a travel arc of contact with the swivel ball assembly when the front steering drive track is swivelled relative to the frame.

6. In combination with a road working machine having a frame supported by and pivotally connected to a forward steering drive track assembly and a rear drive track assembly along one side of the frame, the forward steering drive track assembly being connected to swivel relative to the frame to effect steering of the road working machine, and the elevation of the frame determinable by an elevation control device sensing an elevation control reference, the improvement comprising:

a bar member providing the elevation control reference and having a first end and a second end;

a bar connecting assembly characterized as comprising:

a swivel plate assembly having a generally horizontally disposed bearing surface and supported by the forward steering drive track assembly; and bearing means attached to the first end of the bar member, the bearing means supported by the bearing surface, the swivel plate assembly being disposed so that the first end of the bar member is supported in a position that the front steering drive track assembly serves as a first walking beam, the second end of the bar member pivotally connected to the rear drive track assembly so that the rear drive track assembly serves as a second walking beam, the elevation control reference being the average elevation of the first and second ends of the bar member.

7. The apparatus of claim 6 wherein the bearing means is characterized as comprising a swivel ball assembly with at least one swivel ball in rolling engagement contact with the bearing surface of the swivel plate.

8. The apparatus of claim 7 wherein the swivel plate assembly is characterized as comprising:

a mounting base supported by the front steering drive track assembly; and a platform member supported by the mounting base and containing the bearing surface.

9. The apparatus of claim 8 wherein the platform member is generally curvilinearly shaped to provide a travel arc that is passed under the swivel ball assembly during the swivel tracl of the front steering drive track assembly.

10. In combination with a road working machine having a frame drivingly supported by a forward steering drive track assembly and by first and second rear drive track assemblies pivotally connected to the frame, the frame supporting a work piece for working engagement with the surface of a roadway, the improvement comprising:

a swivel plate assembly having a generally horizontally disposed bearing surface and supported by the forward steering drive track assembly and disposed so that the forward steering drive track assembly serves as a first walking beam, the elevation of the bearing surface indicative of the average grade of the roadway surface supporting the forward steering drive track assembly; and a bar member disposed along a first side of the frame and having a first end and a second end, the first end bearingly supported by the bearing surface of the swivel plate assembly and the second end of the bar member pivotally connected to the first rear drive track assembly so that the first rear drive track assembly serves as a second walking beam, the elevation of the bar member being indicative of the average elevation of the first and second walking beams.

11. The apparatus of claim 10 further comprising:

elevation control means supported by the frame and contacting the bar member for providing a first elevation control signal in response to the elevation of the bar member;

rear hydraulic means connecting the frame to the first rear drive track assembly for establishing the elevation of a rear portion of the frame in response to the first elevation control signal;

averaging means supported along a second side of the frame for providing a second elevation control reference indicative of a selected reference surface along the second side;

second elevation control means supported by the frame and contacting the averaging means for providing a second elevation control signal in response to the second elevation control reference; and forward hydraulic means connecting the frame to the forward steering drive track assembly for establishing the elevation of a forward portion of the frame in response to the second elevation control signal.

12. In combination with a road working machine having a frame supporting a work piece for working contact with a roadway surface, the frame supported by a drive assembly having at least one rear drive track connected to the frame and pivotable about a rear control axis, and the drive assembly having at least one forward steering drive track connected to the frame and pivotable about a forward control axis, the forward steering drive track supported to accommodate swivel rotation to steer the road working machine, and the elevation of the work piece determined by an elevation control device sensing an external elevation control reference, the improvement comprising:

a bar member having a forward end and a rear end, the rear end of the bar member pivotally connected to the rear drive track at a selected attachment point defining a rear elevation reference being constantly fixed relative to the rear control axis, the elevation of the rear elevation reference being indicative of the average grade of the roadway surface supporting the rear drive track; and bar connecting means supporting the forward end of the bar member and connected to the forward steering drive track for providing a pivot point between the forward end of the bar member and the forward steering drive track such that the pivot point defines a forward elevation reference the position of which is constantly fixed relative to the forward control axis throughout the range of swivel of the forward steering drive track, the elevation of the forward elevation reference being determined by the average grade of the roadway surface supporting the forward steering drive track, and the bar member providing the elevation control reference indicative of the average of the forward elevation reference and the rear elevation reference, the bar connecting means comprising:

a swivel plate assembly supported by the forward steering drive track and having a bearing surface; and bearing means attached to the forward end of the bar member for engaging the bearing surface of the swivel plate.

* * * * *

UNITED STATES PATENT AND TRADEMARK OFFICE

CERTIFICATE OF CORRECTION

PATENT NO. : 4,213,719

DATED : July 22, 1980

INVENTOR(S) : George W. Swisher, Jr., et al.

It is certified that error appears in the above-identified patent and that said Letters Patent are hereby corrected as shown below:

In column 3, line 59, the word "planar" should be --planer--.

In column 5, line 44, the word "round" should be --ground--.

In column 6, line 43, the word "cylinder" should be --cylinders--.

In column 7, line 10, the word "left" should be --right--.

In column 8, line 64, the word "to" should be --of--.

In column 12, line 10, after the numeral "34A" add the words --will cause the track assembly to span any smaller depressions--.

In column 12, lines 13 and 14, after the numeral "34A" delete the words "will cause the track assembly to span any smaller depressions,".

In column 14, line 41, the word "tracl" should be --travel--.

Signed and Sealed this

*Eleventh* Day of *November 1980*

[SEAL]

*Attest:*

SIDNEY A. DIAMOND

*Attesting Officer*

*Commissioner of Patents and Trademarl*